US005687750A

United States Patent [19]

Belmonte et al.

[11] Patent Number: 5,687,750

[45] Date of Patent: Nov. 18, 1997

[54] HAIR SUPPORT STRUCTURE

[76] Inventors: Silvano Belmonte, 4418 Radisson Cres., Mississauga, Ontario, Canada, L5M 1C4; Jacqueline Joan Bray, 2504 Oak Row Cr., Mississauga, Ontario, Canada, L5L 1P6; Enzo Constantini, 976 Fernandez Dr., Mississauga, Ontario, Canada, L5V 1W9

[21] Appl. No.: 585,796

[22] Filed: Jan. 16, 1996

[51] Int. Cl.[6] ..... A41G 5/00

[52] U.S. Cl. ..... 132/54

[58] Field of Search ..... 132/53, 54, 55, 132/56, 201, 212, 213, 213.1, 214, 275

[56] References Cited

U.S. PATENT DOCUMENTS

| | | | |
|---|---|---|---|
| 670,857 | 3/1901 | Dorenwend | 132/54 |
| 953,587 | 3/1910 | Bond . | |
| 1,166,932 | 1/1916 | Porter . | |
| 1,368,567 | 2/1921 | MacIntyre | 132/54 |
| 1,413,360 | 4/1922 | Scheanblum | 132/54 |
| 2,729,218 | 1/1956 | Harmon | 132/213 |
| 3,126,018 | 3/1964 | Sidelman | 132/54 |
| 3,126,020 | 3/1964 | Sidelman | 132/212 |
| 3,452,761 | 7/1969 | Siegel | 132/106 |
| 3,638,663 | 2/1972 | Harbison | 132/54 |
| 3,717,157 | 2/1973 | Sidelman | 132/54 |

FOREIGN PATENT DOCUMENTS

| | | | |
|---|---|---|---|
| 10512/32 | 12/1932 | Australia | 132/212 |

*Primary Examiner*—Todd E. Manahan
*Assistant Examiner*—E. Robert
*Attorney, Agent, or Firm*—Donald E. Hewson

[57] ABSTRACT

A hair support structure for use in fashioning a hairstyle on a woman's head, comprises a substantially loop-shaped base portion comprising a thin elongate curved main body element, which is preferably an elongate wire. A plurality of rib members are secured at their bottom ends to the base portion and extend upwardly and generally inwardly therefrom so as to be structurally interconnected one to another, adjacent their top ends, at an elevated reinforcing cross-member. Each of the rib members is spaced apart from adjacent ribs by a distance of at least about one centimeter, and also is unattached along its length between its top end and its bottom end, so as to permit the ready passage of fingers therethrough, for the purpose of winding hair around the rib members. Each of the rib members exhibits stiffness so that the hair support structure is self supporting.

19 Claims, 4 Drawing Sheets

HAIR SUPPORT STRUCTURE

FIELD OF THE INVENTION

This invention relates to hair support structures that are used to fashion a woman's hair into a fancy hairstyle, commonly called a "up-do", and more particularly to such hair support structures that permit ready manipulation of groups of many strands of hair in and around the ribs of the hair support. Focus is also made on such hair support structures that are readily collapsible.

BACKGROUND OF THE INVENTION

It is common for women to fashion their hair in any one of a number of different hairstyles, including some very intricate and ornate hairstyles. Some hairstyles may be fashioned at home; however, it is also common to have an experienced hairstylist who can create or design new hairstyles, especially more complicated, intricate, and ornate hairstyles. Such more complicated, intricate, and ornate hairstyles are typically worn for festive or special occasions such as weddings, Christmas, black tie dinners, and so on.

While the wearing of many types of hairstyles is largely dictated by fashion trends, certain hairstyles remain popular over many years, especially certain conventional hairstyles that are typically worn when "dressing up". One type of hairstyle often worn by women is an "up-do", which essentially is a hairstyle that is formed by back-combing groups of strands of hair, and generally overlapping the groups of strands of hair into a simple form. The groups of strands of hair are pinned one to another at various points in order to secure the "up-do" in place. As formed in this above described manner, only very simple styles are possible. Further, it is generally not possible to make an "up-do" having a significant volume.

Unfortunately, it is quite common for the hairstyle to change its shape over time, essentially falling due to gravity and also movement of the person's head; however, it is quite desirable, even necessary, for such an "up-do" to remain in place without substantial shifting or falling for a period of many hours, virtually a full day. Unfortunately, retention of an "up-do" in its original set position is not guaranteed. Indeed, it is unrealistic to expect that such an "up-do" would remain in its original configuration for more than a few hours, at best.

DESCRIPTION OF THE PRIOR ART

A number of prior art hair support structures exist that provide a stable raised base for pinning hair to in order to help support an "up-do" and also to add volume to the "up-do". These prior art hair support structures will now be discussed.

U.S. Pat. No. 1,166,932 to PORTER discloses a hair dressing foundation that is crescent shaped through its longitudinal section and quadrilateral shaped in its lateral section. A base is formed by end base members and side base members, all of which appear to be formed from a single piece of wire. The base is curved to conform to the shape of a wearer's head. Two upper side members are attached to the end base members, and form the overall expanded shape of the hair dressing foundation. Bracing members are secured at their ends to the base side members and are also wrapped around the upper side members to support the upper side members in place. This patent teaches the general concept of a hair dressing foundation or hair support and further teaches to make a hair support in the form of a lightweight wire frame; however, it does not teach the use of specific shapes.

U.S. Pat. No. 3,452,761 to SIEGEL discloses a hair support comprising a shell-type frame of lightweight, resilient plastic material. A plurality of bowed struts and transverse bowed ribs extend upwardly from and expand across an oval shaped base. Oppositely disposed combs extend outwardly from the base, which combs help hold the hair support in place. U.S. Pat. No. 3,717,157 to SIDELMAN discloses a self-secured foundation that has a lightweight convex plastic frame of intersecting elongate and transverse ribs extending upwardly from an oval base. An anchoring member extends longitudinally between the ends of the base. These two patents teach hair supports that are similar to the present invention, but do not teach the use of a plurality of substantially parallel ribs for receiving hair without cross-member ribs adjoined thereto in order to allow the ready weaving of hair along a rib without interference.

The problem with these prior art hair support structures is that it is difficult to weave hair in and around these hair supports for two reasons: Firstly, the ribs are too close together; secondly, there are reinforcing cross-members in the way, thus preventing ready weaving of the hair along the length of a rib. Accordingly, forming a desired "up-do" to just the right shape is difficult to do. Further, only a very limited number of "up-do"s can be formed with any particular prior art hair support structure.

SUMMARY OF THE INVENTION

In accordance with one aspect of the present invention, there is provided a substantially loop-shaped base portion comprising a thin elongate main body element, and a plurality of rib members secured at their bottom ends to the base portion and extending upwardly and generally inwardly therefrom so as to be structurally interconnected-one to another, adjacent their top ends, at an elevated reinforcing cross-member. Each of the rib members is spaced apart from adjacent ribs by a distance of at least about one centimeter, and also is unattached and fully accessible along its length between its top end and its bottom end. The base portion, each of the rib members, and the reinforcing cross-member exhibit stiffness so that the hair support structure is self supporting.

BRIEF DESCRIPTION OF THE DRAWINGS

Embodiments of this invention will now be described by way of example in association with the accompanying drawings in which:

FIG. 4c is an end elevational view of the third embodiment of FIG. 4a;

FIG. 5b is a side elevational view of the fourth preferred embodiment of FIG. 5a; and FIG. 5c is an end elevational view of the fourth embodiment of FIG. 5a.

DETAILED DESCRIPTION OF THE PREFERRED EMBODIMENTS

Four particular embodiments, each distinguished from the other by its particular shape, will now be discussed with reference to the Figures. Additionally, various other embodiments, each of which differs slightly from the others by its shape, are all possible, all of which fall under the scope of the present invention as claimed herein.

It should be understood that, while hair support structures in keeping with the present invention will typically be used in fashioning hairstyles for women, it is to be expected that men may also find occasion to utilize the present hair support structures; for example, by an actor who is portraying a woman on stage, or film. Further, the hair support structure of the present invention could also be utilized by an actor who is portraying, say, an alien, and who may be required to be "made up" to look as if he has an unusual hair shape.

Figure 1B:
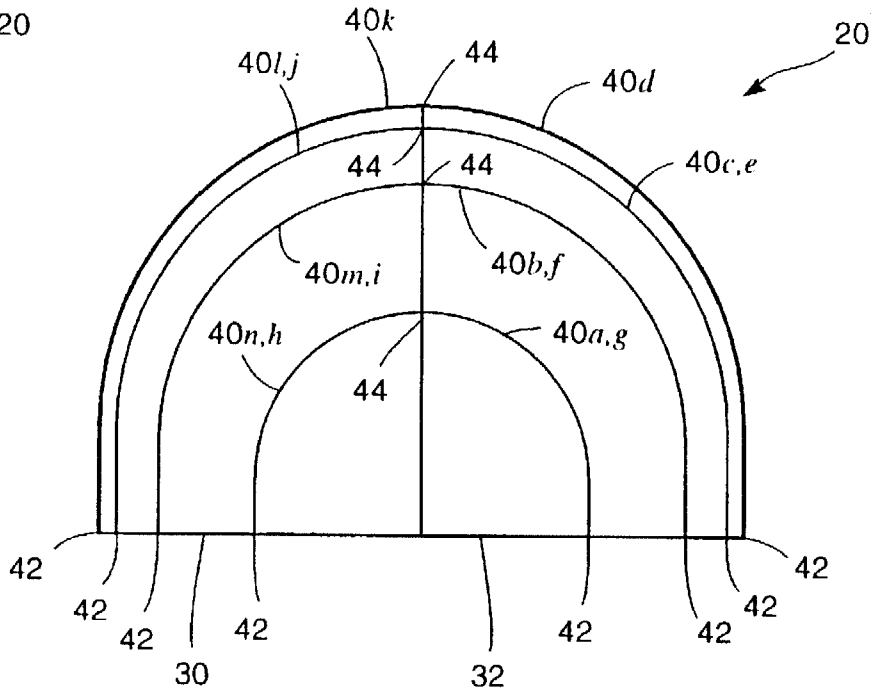
FIG. 1*b* is a side elevational view of the first preferred embodiment of FIG. 1*a;*
Figure 1A:
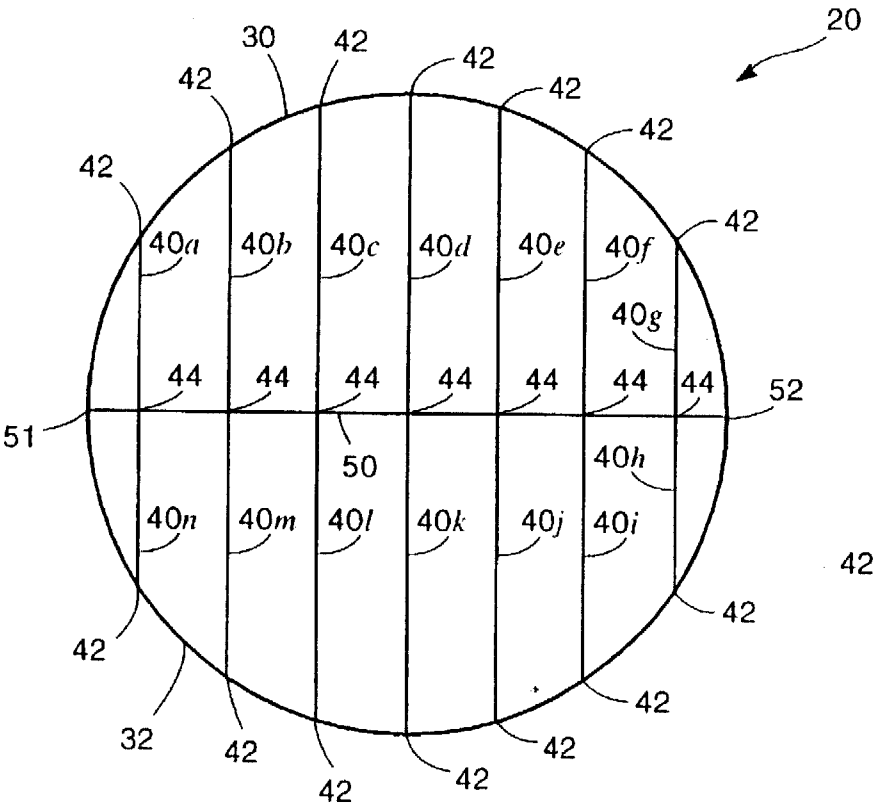
FIG. 1*a* is a top plan view of a first preferred embodiment of the present invention.
Figure 1C:
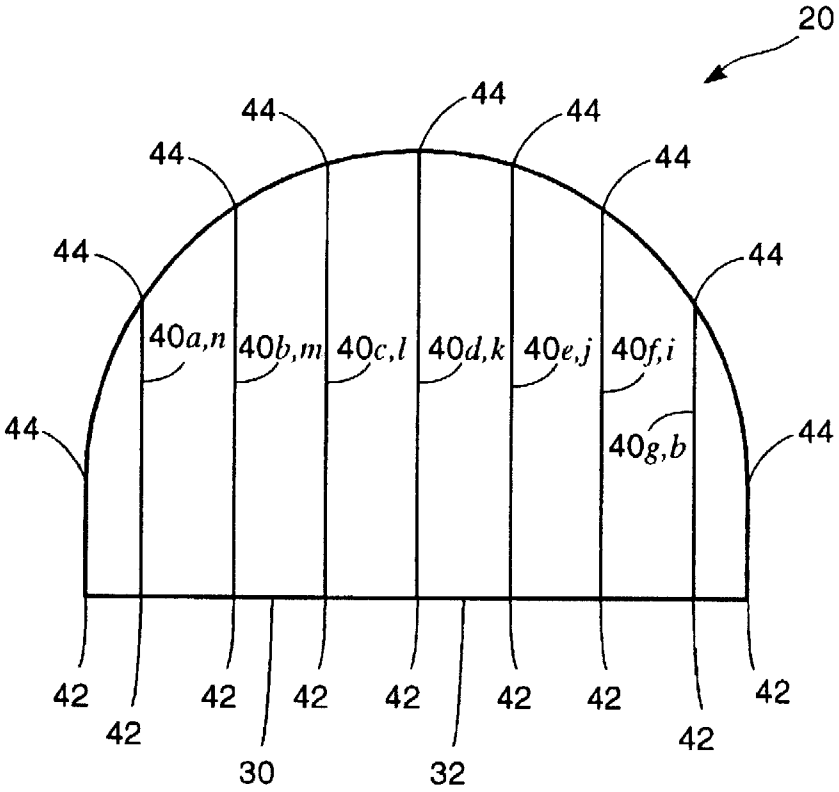
FIG. 1*c* is an end elevational view of the first embodiment of FIG. 1*a;*

Reference will now be made to FIGS. 1a through 1c, which show a first structural embodiment of the hair support structure 20 of the present invention. The hair support structure 20 comprises a substantially loop-shaped base portion 30. In this structural embodiment, the base portion is in the form of a substantially circularly shaped planar closed loop. The base portion 30 comprises a thin elongate main body element 32 that is curved appropriately so as to form the desired shape.

A plurality of curved rib members 40—denoted separately as 40a through 40n in this structural embodiment—are secured at their bottom ends 42 to the base portion 30 and extend upwardly and generally inwardly from the base portion 30. The rib members 40 are structurally connected one to another adjacent their top ends 44, at an elevated reinforcing cross-member 50. Preferably, the reinforcing cross-member 50 is elongate, having a first end 51 and a second end 52, with the first end 51 of the reinforcing cross-member being secured to the base portion 30 and the second end 52 of the reinforcing cross-member also being secured to the base portion 30. In an alternative embodiment (not shown), it is possible to have one or both of the first end 51 and the second end 52 terminate at one pair of the two outermost pairs of rib members 40a,40n and 40g, 40h thus leaving an opening between the respective outermost pairs of rib members 40a,40n or 40g,40h and the portion of the base portion 30 adjacent thereto. Such an opening would be of suitable size for receiving an amount of hair therethrough, and thereby may be used to create certain hairstyles.

The rib members 40 are generally parallel one to the other, in a curved parallel sense, and each of the rib members 40 is spaced apart from adjacent ones by a distance of at least about one centimeter. In this manner, it is possible for the hairstylist, in particular, to fit his or her fingers between adjacent rib members 40 to thereby weave groups of strands of hair around one or more of the chosen rib members 40 with the fingers. Also, each of the rib members 40 is unattached and fully accessible along its length "L" between its top end 44 and its bottom end 42—that is to say that no other part of the hair support structure 20 contacts the rib members 40 along their length so as to provide full and unencumbered access to the rib for a distance of at least about three centimeters, or preferably more. In this manner, groups of strands of hair may be woven around one or more of the rib members 40 for a substantial distance without interference by a cross-member or the like.

In the first structural embodiment, the base portion 30, the plurality of rib members 40, and the elevated reinforcing cross-member 50 are each made from thin wire, that is also relatively stiff. In this manner, the base portion 30, each of the rib members 40, and the reinforcing cross-member 50 each exhibit stiffness so that the hair support structure 20 of the present invention is self-supporting. Typically, the base portion 30, the rib members 40, and the reinforcing cross-member 50, are welded one to the other, to form the overall hair support structure 20.

Figure 2:
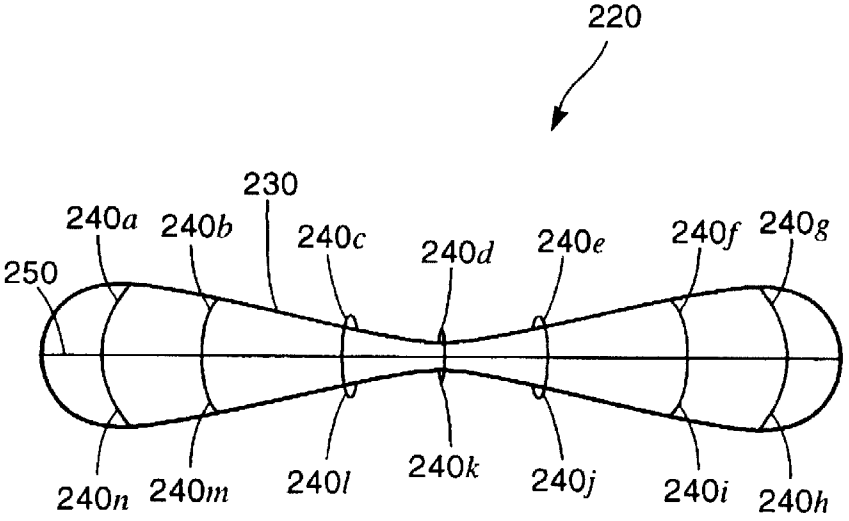
FIG. 2 is a top plan view of an alternative embodiment of the first embodiment of FIG. 1, shown in a collapsed form.

In an alternative embodiment of the first structural embodiment, as shown in FIG. 2, the substantially loop-shaped based portion 230, the plurality of rib members 240 (240a through 240n), and the elevated reinforcing cross-member 250 are each made from a flexible material such as stranded wire material, and are welded one to another, so as to form a resiliently collapsible hair support structure 220. The resiliently collapsible hair support structure 220 is shown in a collapsed configuration, and must be retained in this collapsed configuration by means of an external pressure, such as by tying or by packaging. When in its expanded "in-use" configuration, the hair support structure 220 forms the same shape as the hair support structure 20 as shown in FIG. 1.

Figure 3A:
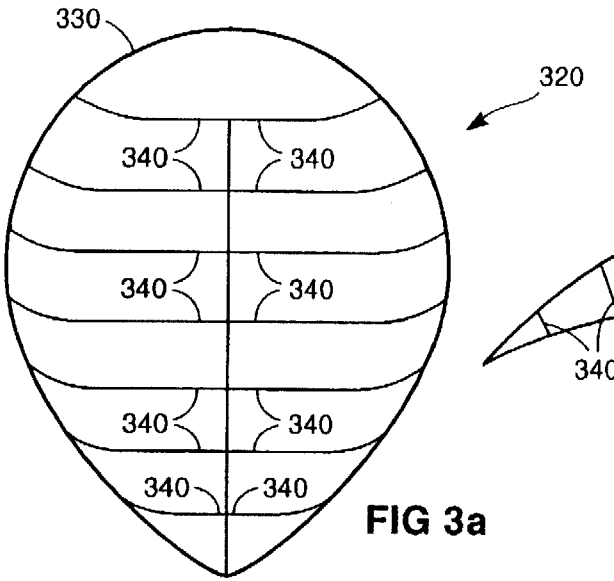
FIG. 3*a* is a top plan view of a second preferred embodiment of the present invention.
Figure 3B:
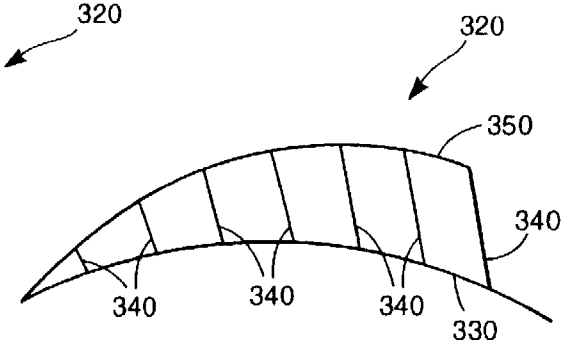
FIG. 3*b* is a side elevational view of the second preferred embodiment of FIG. 3*a;*
Figure 3C:
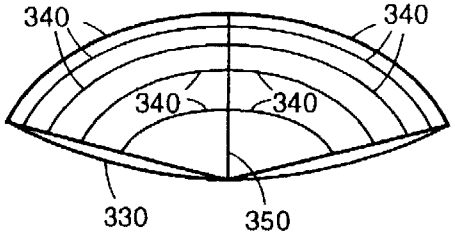
FIG. 3*c* is an end elevational view of the second embodiment of FIG. 3*a;*

In a second structural embodiment, as can be seen in FIG. 3, the hair support structure 320 comprises a substantially loop-shaped base portion 330, a plurality of rib members 340, and an elevated reinforcing cross-member 350, in a manner analogous to that in the first structural embodiment as shown in FIG. 1. The base portion 330 is shaped somewhat differently than the first structural embodiment in that it is substantially tear-drop shaped and is downwardly concave when viewed from the side.

Figure 4B:
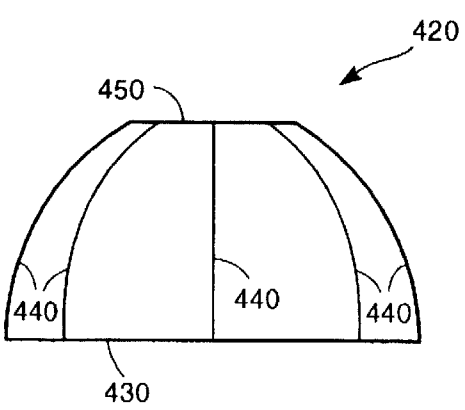
FIG. 4*b* is a side elevational view of the third preferred embodiment of FIG. 4*a;*
Figure 4C:
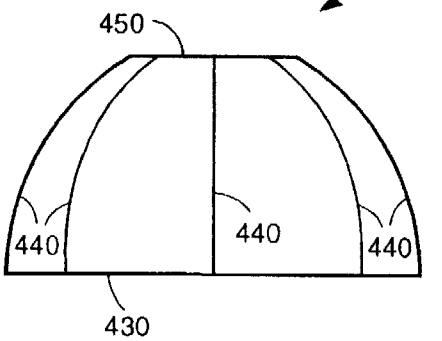
Figure 4A:
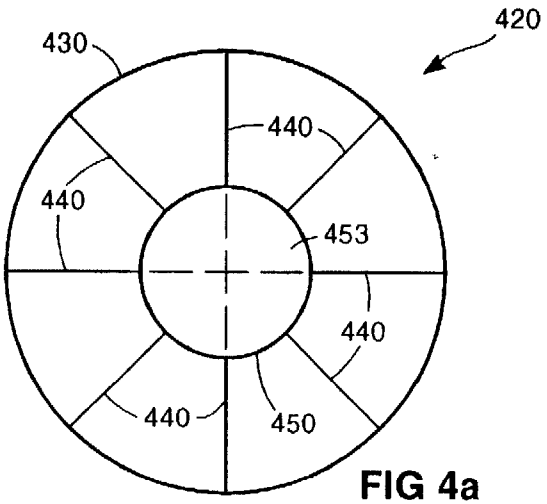
FIG. 4*a* is a top plan view of a third preferred embodiment of the present invention.

In a third structural embodiment, as shown in FIG. 4, the hair support structure 420 again comprises a substantially loop-shaped base portion 430, a plurality of rib members 440, and an elevated reinforcing cross-member in the form of a crown member 450. The crown member 450 includes a generally centrally disposed aperture 453 of at least two centimeters in diameter. The aperture 453 permits fingers and also groups of strands of hair to be inserted therein so as to form a desired hairstyle.

Figure 5A:
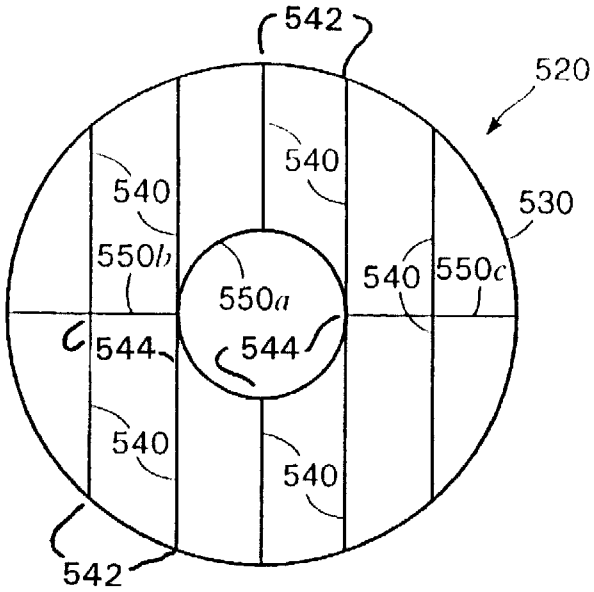
FIG. 5a is a top plan view of a fourth preferred embodiment of the present invention.
Figure 5C:
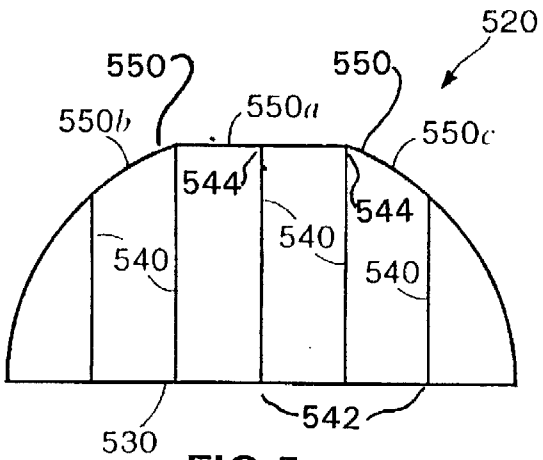
Figure 5B:
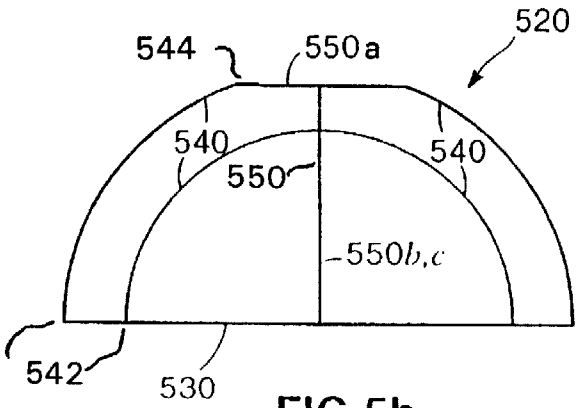

In a fourth structural embodiment, as shown in FIG. 5, the hair support structure 520 comprises a substantially circular base member 530, a plurality of rib members 540, and an elevated reinforcing cross-member 550 that comprises a crown member 550a and two elongate portions 550b, 550c extending outwardly from the crown member 550a. Each of the rib members 540 is secured at their bottom ends 542 to the base portion 530 and they are structurally interconnected one to another, adjacent their top ends 544 at either the crown member 550a or the elongate portions 550b, 550c of the elevated reinforcing cross-member 550. This particular style of hair support structure 520 permits hair to be woven in a generally parallel pattern similar to that of the hair support structure 20 shown in FIG. 1, but with a circular aperture at the top for receiving hair therethrough, in a manner similar to the hair support structure 420 as shown in FIG. 4.

It should be understood that any of the second through fourth structural embodiments shown may also have an alternative embodiment analogous to the alternative embodiment of the first structural embodiment, in that they may be made from a flexible material such as stranded wire material, in which the wires are welded one to another, so as to form a resiliently collapsible hair support structure.

It can be readily seen that with the various embodiments of the hair support structure 20 of the present invention, a greater number of fancy and intricate "up-do"s can be formed than can be formed with the various prior art hair support structures.

Other modifications and alterations may be used in the design and manufacture of the apparatus of the present invention without departing from the spirit and scope of the accompanying claims.

What is claimed is:

1. A hair support structure for use in fashioning and maintaining a hairstyle on a woman's head while in place thereon, said hair support structure comprising:

a pre-formed substantially loop-shaped base portion comprising a thin elongate main body element; and at least four resiliently collapsible pre-formed rib members, each having top ends and bottom ends, and being permanently secured at their bottom ends to said base portion and extending upwardly and generally inwardly therefrom so as to be structurally interconnected one to another, adjacent their top ends, at an elevated reinforcing cross-member, and wherein each of said rib members is spaced apart from adjacent rib members by a distance of at least about one centimetre and also is unattached and fully accessible along its length between its top end and its bottom end, and wherein said base portion, each of said rib members, and said reinforcing cross-member exhibit stiffness so that said hair support structure is self supporting.

2. The hair support structure of claim 1, wherein said thin elongate main body element is curved.

3. The hair support structure of claim 1, wherein said substantially loop-shaped base portion comprises a closed loop.

4. The hair support structure of claim 3, wherein said closed loop-shaped base portion is substantially planar.

5. The hair support structure of claim 1, wherein said substantially loop-shaped base portion, said plurality of rib members, and said elevated reinforcing cross-member are each made from thin wire.

6. The hair support structure of claim 5, wherein said substantially loop-shaped base portion, said plurality of rib members, and said elevated reinforcing cross-member are welded one to another.

7. The hair support structure of claim 1, wherein said substantially loop-shaped base portion, said plurality of rib members, and said elevated reinforcing cross-member are each made from a flexible material so as to form a resiliently collapsible hair support structure.

8. The hair support structure of claim 7, wherein said flexible material comprises stranded wire material.

9. The hair support structure of claim 8, wherein said substantially loop-shaped base portion, said plurality of rib members, and said elevated reinforcing cross-member are welded one to another.

10. The hair support structure of claim 1, wherein said plurality of rib members are generally parallel one to another.

11. The hair support structure of claim 1, wherein said plurality of rib members are curved.

12. The hair support structure of claim 1, wherein said elevated reinforcing cross-member comprises a crown member.

13. The hair support structure of claim 12, wherein said crown member includes a generally centrally disposed aperture of at least two centimeters in diameter.

14. The hair support structure of claim 1, wherein said elevated reinforcing cross-member is elongate, having a first end and a second end.

15. The hair support structure of claim 14, wherein said first end of said reinforcing cross-member is secured to said base portion.

16. The hair support structure of claim 15, wherein said second end of said reinforcing cross-member is secured to said base portion.

17. The hair support structure of claim 1, wherein said base portion is substantially planar.

18. The hair support structure of claim 17, wherein said base portion is substantially circular in shape.

19. The hair support structure of claim 1, wherein said base portion is substantially tear-drop shaped and said base portion is downwardly concave.

* * * * *